US010514647B2

(12) United States Patent
Kitamura

(10) Patent No.: US 10,514,647 B2
(45) Date of Patent: Dec. 24, 2019

(54) IMAGE FORMING DEVICE

(71) Applicant: KONICA MINOLTA, INC., Chiyoda-ku, Tokyo (JP)

(72) Inventor: Kazuya Kitamura, Nagoya (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/278,650

(22) Filed: Feb. 18, 2019

(65) Prior Publication Data

US 2019/0302670 A1 Oct. 3, 2019

(30) Foreign Application Priority Data

Mar. 27, 2018 (JP) ..... 2018-059286

(51) Int. Cl.
*G03G 15/00* (2006.01)

(52) U.S. Cl.
CPC ..... *G03G 15/5062* (2013.01); *G03G 15/5029* (2013.01)

(58) Field of Classification Search
CPC ..... G03G 15/5062; G03G 15/5029; G03G 2215/00734; G03G 2215/00738; G03G 2215/00742; G03G 2215/00751; G03G 15/6508; G03G 15/6514
See application file for complete search history.

(56) References Cited

U.S. PATENT DOCUMENTS

2017/0336748 A1* 11/2017 Maejima ..... G03G 15/6514

FOREIGN PATENT DOCUMENTS

JP 2007058084 A 3/2007
JP 2012181223 A 9/2012

* cited by examiner

*Primary Examiner* — Sandra Brase
(74) *Attorney, Agent, or Firm* — Holtz, Holtz & Volek PC

(57) ABSTRACT

An image forming device that forms an image on a sheet under an operating condition set according to a type of the sheet, includes a hardware processor that: accepts a manual input specifying any one of a plurality of types; stores manual mode setting information and automatic mode setting information; detects which of a plurality of types included in an automatic type group the type of the sheet is based on an output of a sensor; and sets an operating condition value corresponding to a type detected out of the operating condition values indicated by the automatic mode setting information as the operating condition in an automatic mode, and sets an operating condition value corresponding to the type specified by the manual input out of the operating condition values indicated by the manual mode setting information as the operating condition in a manual mode.

10 Claims, 12 Drawing Sheets

FIG. 3

D30

D31

| MANUAL MODE SETTING INFORMATION | | | | |
|---|---|---|---|---|
| TYPE NAME OF MANUAL TYPE GROUP | BASIS WEIGHT [g/m²] | PROCESS SPEED [mm/s] | FIXING TEMPERATURE [°C] | TRANSFER OUTPUT [V] |
| THIN PAPER | 51 TO 60 | 200 | 145 | 1500 |
| PLAIN PAPER | 61 TO 90 | | 165 | 1800 |
| HEAVY PAPER 1 | 91 TO 120 | 100 | 140 | 1300 |
| HEAVY PAPER 2 | 121 TO 160 | | 150 | 1600 |
| HEAVY PAPER 3 | 161 TO 210 | | 155 | 1900 |
| HEAVY PAPER 4 | 211 TO 260 | | 160 | 2200 |
| HEAVY PAPER 5 | 261 TO 300 | | 170 | 2500 |
| Dk1 | Dr1 | Dc1 | Dc2 | Dc3 |
| MK | | Dc | | |

D32

| AUTOMATIC MODE SETTING INFORMATION | | | | |
|---|---|---|---|---|
| TYPE NAME OF AUTOMATIC TYPE GROUP | BASIS WEIGHT [g/m²] | PROCESS SPEED [mm/s] | FIXING TEMPERATURE [°C] | TRANSFER OUTPUT [V] |
| THIN PAPER A | 51 TO 55 | 200 | 140 | 1450 |
| THIN PAPER B | 56 TO 60 | | 145 | 1550 |
| PLAIN PAPER A | 61 TO 75 | | 160 | 1750 |
| PLAIN PAPER B | 76 TO 90 | | 165 | 1850 |
| HEAVY PAPER 1A | 91 TO 105 | 100 | 135 | 1200 |
| HEAVY PAPER 1B | 106 TO 120 | | 140 | 1400 |
| HEAVY PAPER 2A | 121 TO 140 | | 145 | 1500 |
| HEAVY PAPER 2B | 141 TO 160 | | 150 | 1700 |
| HEAVY PAPER 3A | 161 TO 180 | | 153 | 1800 |
| HEAVY PAPER 3B | 181 TO 210 | | 155 | 2000 |
| HEAVY PAPER 4A | 211 TO 230 | | 158 | 2100 |
| HEAVY PAPER 4B | 231 TO 260 | | 160 | 2300 |
| HEAVY PAPER 5A | 261 TO 280 | | 165 | 2400 |
| HEAVY PAPER 5B | 281 TO 300 | | 170 | 2600 |
| Dk2 | Dr2 | Dc1 | Dc2 | Dc3 |
| AK | | Dc | | |

FIG. 4A

D20

| TRAY | Ds: SIZE | Dd: DIRECTION | Dm: MODE | Dk1: MANUAL TYPE | Dk2: AUTOMATIC TYPE |
|---|---|---|---|---|---|
| TRAY 1 (PAPER FEED TRAY 25a) | A4 | HORIZONTAL (H) | AUTOMATIC | --- | (UNKNOWN) |
| TRAY 2 (PAPER FEED TRAY 25b) | A4 | HORIZONTAL (H) | MANUAL | HEAVY PAPER 1 | --- |
| TRAY 3 (PAPER FEED TRAY 25c) | A3 | VERTICAL (V) | MANUAL | PLAIN PAPER | --- |
| TRAY 4 (MANUAL FEED TRAY 25d) | A4 | VERTICAL (V) | MANUAL | PLAIN PAPER | --- |

FIG. 4B

D20

| TRAY | Ds: SIZE | Dd: DIRECTION | Dm: MODE | Dk1: MANUAL TYPE | Dk2: AUTOMATIC TYPE |
|---|---|---|---|---|---|
| TRAY 1 (PAPER FEED TRAY 25a) | A4 | HORIZONTAL (H) | AUTOMATIC | (PLAIN PAPER) | PLAIN PAPER A |
| TRAY 2 (PAPER FEED TRAY 25b) | A4 | HORIZONTAL (H) | MANUAL | HEAVY PAPER 1 | --- |
| TRAY 3 (PAPER FEED TRAY 25c) | A3 | VERTICAL (V) | MANUAL | PLAIN PAPER | --- |
| TRAY 4 (MANUAL FEED TRAY 25d) | A4 | VERTICAL (V) | MANUAL | PLAIN PAPER | --- |

FIG. 9

D31

| MANUAL MODE SETTING INFORMATION | | | | |
|---|---|---|---|---|
| TYPE NAME OF MANUAL TYPE GROUP | BASIS WEIGHT [g/m$^2$] | PROCESS SPEED [mm/s] | FIXING TEMPERATURE [°C] | TRANSFER OUTPUT [V] |
| THIN PAPER | 51 TO 60 | 200 | 145 | 1500 |
| PLAIN PAPER | 61 TO 90 | | 165 | 1800 |
| HEAVY PAPER 1 | 91 TO 120 | 100 | 140 | 1300 |
| HEAVY PAPER 2 | 121 TO 160 | | 150 | 1600 |
| HEAVY PAPER 3 | 161 TO 210 | | 155 | 1900 |
| HEAVY PAPER 4 | 211 TO 260 | | 160 | 2200 |
| HEAVY PAPER 5 | 261 TO 300 | | 170 | 2500 |
| Dk1 | Dr1 | DC1 | Dc2 | Dc3 |

D31a

| MANUAL MODE SETTING INFORMATION | | | | |
|---|---|---|---|---|
| TYPE NAME OF MANUAL TYPE GROUP | BASIS WEIGHT [g/m$^2$] | PROCESS SPEED [mm/s] | FIXING TEMPERATURE [°C] | TRANSFER OUTPUT [V] |
| THIN PAPER | 51 TO 60 | 200 | 145 | 1500 |
| PLAIN PAPER | 61 TO 90 | | 160 | 1750 |
| HEAVY PAPER 1 | 91 TO 120 | 100 | 140 | 1300 |
| HEAVY PAPER 2 | 121 TO 160 | | 150 | 1600 |
| HEAVY PAPER 3 | 161 TO 210 | | 155 | 1900 |
| Dk1 | Dr1 | DC1 | Dc2 | Dc3 |

FIG. 10

D30b

D31

| MANUAL MODE SETTING INFORMATION | | | | |
|---|---|---|---|---|
| TYPE NAME OF MANUAL TYPE GROUP | BASIS WEIGHT [g/m²] | PROCESS SPEED [mm/s] | FIXING TEMPERATURE [°C] | TRANSFER OUTPUT [V] |
| THIN PAPER | 51 TO 60 | 200 | 145 | 1500 |
| PLAIN PAPER | 61 TO 90 | | 165 | 1800 |
| HEAVY PAPER 1 | 91 TO 120 | 100 | 140 | 1300 |
| HEAVY PAPER 2 | 121 TO 160 | | 150 | 1600 |
| HEAVY PAPER 3 | 161 TO 210 | | 155 | 1900 |
| HEAVY PAPER 4 | 211 TO 260 | | 160 | 2200 |
| HEAVY PAPER 5 | 261 TO 300 | | 170 | 2500 |
| Dk1 | Dr1 | Dc1 | Dc2 | Dc3 |
| MK | | Dc | | |

D32b

| AUTOMATIC MODE SETTING INFORMATION | | | | |
|---|---|---|---|---|
| TYPE NAME OF AUTOMATIC TYPE GROUP | BASIS WEIGHT [g/m²] | PROCESS SPEED [mm/s] | FIXING TEMPERATURE [°C] | TRANSFER OUTPUT [V] |
| THIN PAPER A | 51 TO 55 | 200 | 140 | 1450 |
| THIN PAPER B | 56 TO 65 | | 145 | 1550 |
| PLAIN PAPER A | 66 TO 85 | | 160 | 1750 |
| PLAIN PAPER B | 86 TO 95 | | 165 | 1850 |
| HEAVY PAPER 1A | 96 TO 115 | 100 | 135 | 1200 |
| HEAVY PAPER 1B | 116 TO 125 | | 140 | 1400 |
| HEAVY PAPER 2A | 126 TO 155 | | 145 | 1500 |
| HEAVY PAPER 2B | 156 TO 165 | | 150 | 1700 |
| HEAVY PAPER 3A | 166 TO 205 | | 153 | 1800 |
| HEAVY PAPER 3B | 206 TO 215 | | 155 | 2000 |
| HEAVY PAPER 4A | 216 TO 255 | | 158 | 2100 |
| HEAVY PAPER 4B | 265 TO 265 | | 160 | 2300 |
| HEAVY PAPER 5A | 266 TO 285 | | 165 | 2400 |
| HEAVY PAPER 5B | 286 TO 305 | | 170 | 2600 |
| Dk2 | Dr2b | Dc1 | Dc2 | Dc3 |
| AKb | | Dc | | |

FIG. 12

D30c

D31

| MANUAL MODE SETTING INFORMATION | | | | |
|---|---|---|---|---|
| TYPE NAME OF MANUAL TYPE GROUP | BASIS WEIGHT [g/m²] | PROCESS SPEED [mm/s] | FIXING TEMPERATURE [°C] | TRANSFER OUTPUT [V] |
| THIN PAPER | 51 TO 60 | 200 | 145 | 1500 |
| PLAIN PAPER | 61 TO 90 | | 165 | 1800 |
| HEAVY PAPER 1 | 91 TO 120 | 100 | 140 | 1300 |
| HEAVY PAPER 2 | 121 TO 160 | | 150 | 1600 |
| HEAVY PAPER 3 | 161 TO 210 | | 155 | 1900 |
| HEAVY PAPER 4 | 211 TO 260 | | 160 | 2200 |
| HEAVY PAPER 5 | 261 TO 300 | | 170 | 2500 |
| Dk1 | Dr1 | Dc1 | Dc2 | Dc3 |
| MK | | Dc | | |

D32c

| AUTOMATIC MODE SETTING INFORMATION | | | | |
|---|---|---|---|---|
| TYPE NAME OF AUTOMATIC TYPE GROUP | BASIS WEIGHT [g/m²] | PROCESS SPEED [mm/s] | FIXING TEMPERATURE [°C] | TRANSFER OUTPUT [V] |
| THIN PAPER A | 51 TO 55 | 200 | 140 | 1450 |
| THIN PAPER B | 56 TO 60 | | 145 | 1550 |
| PLAIN PAPER A | 61 TO 75 | | 160 | 1750 |
| PLAIN PAPER B | 76 TO 90 | | 165 | 1850 |
| HEAVY PAPER 1A | 91 TO 105 | 100 | 135 | 1200 |
| HEAVY PAPER 1B | 106 TO 120 | | 140 | 1400 |
| HEAVY PAPER 2 | 121 TO 160 | | 150 | 1600 |
| HEAVY PAPER 3 | 161 TO 210 | | 155 | 1900 |
| HEAVY PAPER 4 | 211 TO 260 | | 160 | 2200 |
| HEAVY PAPER 5 | 261 TO 300 | | 170 | 2500 |
| Dk2c | Dr2c | Dc1 | Dc2 | Dc3 |
| AKc | | Dc | | |

IMAGE FORMING DEVICE

The entire disclosure of Japanese patent Application No. 2018-059286, filed on Mar. 27, 2018, is incorporated herein by reference in its entirety.

BACKGROUND

Technological Field

The present invention relates to an image forming device.

Description of the Related Art

An image forming device such as a printer, a copying machine, and a complex machine includes a sheet table (tray, cassette and the like) on which a plurality of sheets used as image recording media is set, and this performs printing while conveying the sheet from the sheet table to a printing position in the device.

As a function of this type of image forming device, a function of setting an operating condition so as to obtain an appropriate image according to the type of sheet is known. For example, in an electrophotographic image forming device, sheets are classified according to a basis weight, and a conveying speed (process speed), a transfer bias, a fixing temperature and the like are set according to the basis weight. By this setting, it is possible to prevent jamming, transfer failure, fixing failure and the like.

As a method for the image forming device to obtain the type of sheet, there is a manual input in which a user selects to specify the type of sheet from several options (plain paper, heavy paper 1, heavy paper 2 and the like). The image forming device sets the operating condition of printing according to the type manually input by the user.

However, it is troublesome for the user to specify the type each time the type of sheet to be set is changed. Also, there is a possibility that the user forgets to specify or erroneously specifies. Therefore, automatic detection in which the image forming device detects the type of the sheet based on an output of a predetermined sensor attracts attention.

As a conventional technology relating to an image forming device that automatically detects the type of sheet, there are technologies disclosed in JP 2007-58084 A and JP 2012-181223 A.

JP 2007-58084 A discloses an image forming device that displays a message recommending manual setting of an image forming mode when an output of a sensor is a value within a boundary region of automatic discrimination (automatic detection) of a type.

JP 2012-181223 A discloses that a user may manually set a paper type, and also when the manual setting is performed, the paper type is automatically discriminated, a result is compared with the paper type by the manual setting, and if they are different from each other, it is selected whether to display this, stop printing, or continue printing.

By providing a function of automatically detecting the type of sheet, it is possible to set the operating condition of printing to obtain a more preferable image by subdividing the type without increasing a burden on the user. For example, it is possible to change the operating condition according to attribute values such as the basis weight and water content, instead of printing uniformly under the same operating condition as for the plain paper being the most common sheet. That is, automatic detection has an advantage that this is advantageous in terms of reducing the burden on the user and optimizing the operating condition of printing.

However, in recent years, the types of sheets usable in the image forming device are diversified. For example, it is possible to use thicker sheets than before, and the number of types classified by thickness is increasing. In a case of detecting various types, a sensor having a wide range of detectable attribute values is necessary, or a plurality of attribute values need to be detected using a plurality of sensors. Therefore, a cost of parts increases. Also, when comprehensively determining a plurality of attribute values to detect the type, a detection process becomes complicated and a required time becomes long. As the time required for detection increases, the start of printing is delayed by that amount, and the productivity decreases.

On the other hand, the manual input of type has an advantage that it is easy to respond to diversification of types as follows. Generally, a user may discriminate each of a plurality of attributes such as thickness, color, gloss, surface roughness, transparency, single leaf, and multiple leaf and may relatively easily determine to which of a plurality of options the sheet type corresponds. Also, it is considered that the user using a special sheet has knowledge about the sheet to such an extent that he/she may specify the type without hesitation.

However, conventionally, when setting the operating condition of printing according to the type of the sheet, there is a problem that advantages of both the automatic detection and manual input cannot be satisfied.

The technology in JP 2007-58084 A described above classifies sheets assumed to be used into a plurality of types A specified by automatic detection and a plurality of types B specified by manual input. Basically, the type is specified by automatic detection, but when using the sheet of type B, the user is forced to manually input. For this reason, the advantage of automatic detection of reducing the burden on the user is lost.

The technology in JP 2012-181223 A enables selection between automatic detection and manual input, but it is assumed that a plurality of types A to be automatically detected and a plurality of types B to be manually input are the same. Therefore, for example, if the number of types A is increased in order to optimize the operating condition of printing, the number of options for manual input increases, so that the burden on the user who performs manual input increases. In addition, when the number of types B is increased in order to diversify types, the number of types A also increases, and problems such as the necessity of a sensor capable of detecting various attributes as described above become apparent.

SUMMARY

The present invention is achieved in view of the above problems, and an object thereof is to provide an image forming device capable of satisfying advantages of both the automatic detection and manual input of types when setting the operating condition of printing according to the type of sheets.

To achieve the abovementioned object, according to an aspect of the present invention, there is provided an image forming device that forms an image on a sheet under an operating condition set according to a type of the sheet, and the image forming device reflecting one aspect of the present invention comprises a hardware processor that: accepts a manual input specifying any one of a plurality of types included in a manual type group as the type of the sheet stores manual mode setting information indicating an operating condition value corresponding to each of the plurality of types included in the manual type group, and automatic mode setting information indicating an operating condition value corresponding to each of a plurality of types included in an automatic type group; detects which of the plurality of types included in the automatic type group the type of the sheet is based on an output of a sensor that detects the type of the sheet; and sets an operating condition value corresponding to a type detected out of the operating condition values indicated by the automatic mode setting information as the operating condition in an automatic mode, and sets an operating condition value corresponding to the type specified by the manual input out of the operating condition values indicated by the manual mode setting information as the operating condition in a manual mode, wherein at least two types included in the automatic type group are different from any of the types included in the manual type group.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 3 is a view illustrating an example of an operating condition setting table;

FIGS. 4A and 4B are views illustrating a data configuration of tray information;

FIG. 9 is a view illustrating change in manual mode setting information based on setting frequency information;

FIG. 10 is a view illustrating a variation of an operating condition setting table;

FIG. 12 is a view illustrating another variation of an operating condition setting table.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
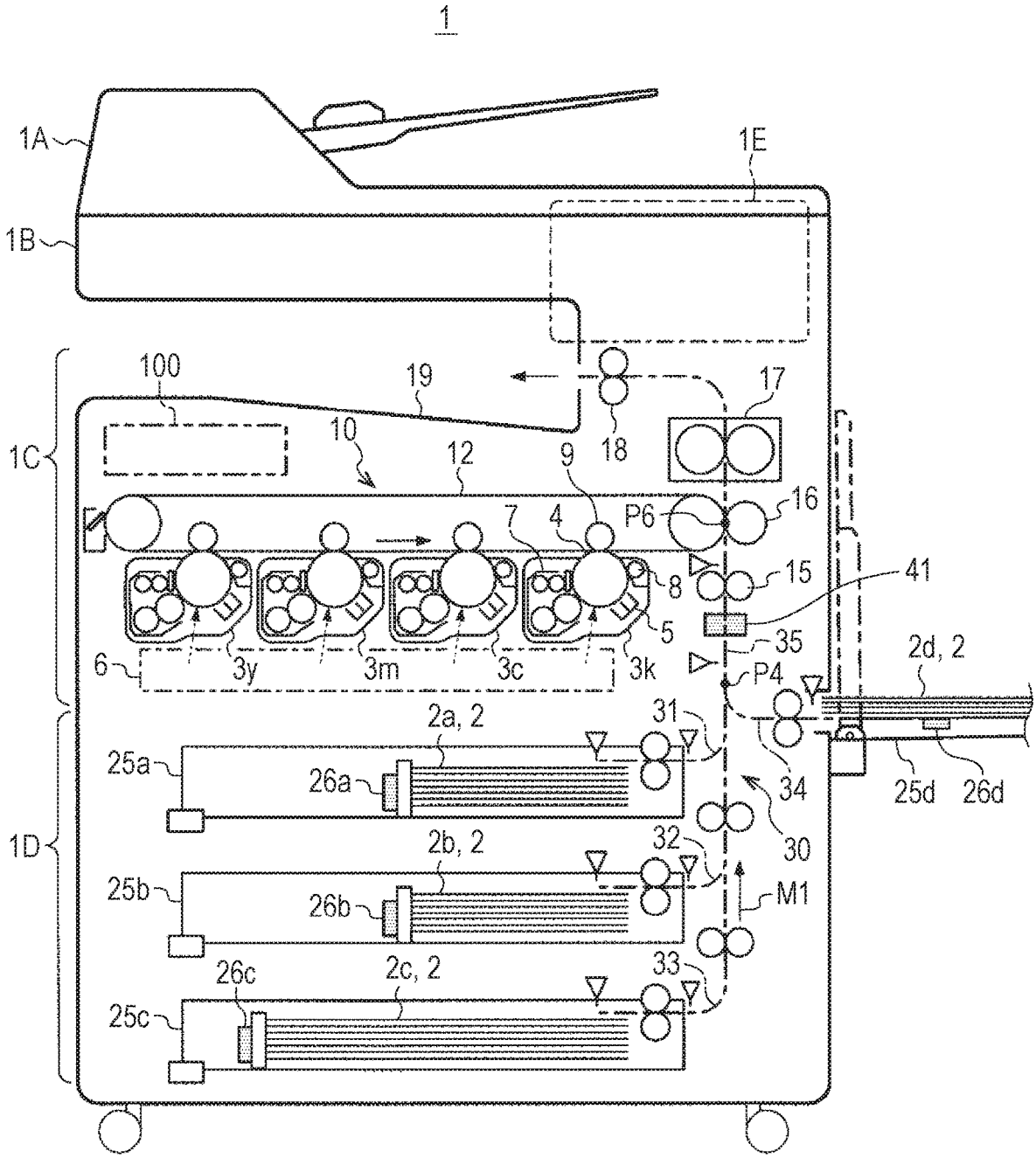
FIG. 1 is a view illustrating an outline of a configuration of an image forming device according to one embodiment of the present invention.

FIG. 1 illustrates an outline of a configuration of an image forming device 1 according to one embodiment of the present invention. The image forming device 1 is a multi-functional peripheral (MFP: multi-functional machine or complex machine) integrating functions of a copying machine, a printer, a facsimile machine, an image reader and the like.

The image forming device 1 is provided with an auto document feeder (ADF) 1A, a flat bed type scanner 1B, an electrophotographic color printer 1C, a sheet cabinet 1D, an operation panel 1E and the like.

The sheet cabinet 1D is a drawer type with a three-stage configuration provided with paper feed trays 25*a*, 25*b*, and 25*c*. On a right side surface portion of the image forming device 1, a manual feed tray 25*d* is provided. The operation panel 1E including a touch panel display for displaying a screen for operation by a user outputs a signal corresponding to an input operation. In response to this signal, an operation of the image forming device 1 is controlled by a control circuit 100.

The auto document feeder 1A conveys a document (sheet) set on a document tray to a reading position of the scanner 1B. The scanner 1B reads an image from a sheet-shaped document conveyed from the auto document feeder 1A or various documents set on a platen glass to generate image data.

The color printer 1C forms a color or monochrome image on one side or both sides of a recording sheet (paper) 2 in a print job such as copying, network printing (PC printing), facsimile reception, box printing and the like. The color printer 1C is provided with an electrophotographic tandem type printer engine 10, and the printer engine 10 includes four imaging units 3*y*, 3*m*, 3*c*, and 3*k*, a print head 6, and an intermediate transfer belt 12.

Each of the imaging units 3*y* to 3*k* includes a cylindrical photoreceptor 4, a charger 5, a developer 7, a cleaner 8 and the like. The imaging units 3*y* to 3*k* have basically similar configurations.

The print head 6 emits a laser beam for pattern exposure to each of the imaging units 3*y* to 3*k*. The print head 6 performs main scanning for deflecting the laser beam in a rotation axis direction of the photoreceptor 4. In parallel to this main scanning, sub scanning is performed to rotate the photoreceptor 4 at a constant speed.

The intermediate transfer belt 12 being a member to be transferred in primary transfer of a toner image is wound around a pair of rollers to rotate. On an inner side of the intermediate transfer belt 12, a primary transfer roller 9 is arranged for each of the imaging units 3*y*, 3*m*, 3*c*, and 3*k*.

In a color printing mode, the imaging units 3*y* to 3*k* form toner images of four colors of yellow (Y), magenta (M), cyan (C), and black (K) in parallel. The toner images of four colors are sequentially primarily transferred to the rotating intermediate transfer belt 12. First, the toner image of Y is transferred, and the toner image of M, the toner image of C, and the toner image of K are sequentially transferred so as to overlap with the same.

The toner image primarily transferred is secondarily transferred to the sheet 2 taken out from any one of the paper feed trays 25*a* to 25*c* or the manual feed tray 25*d* to be conveyed through a timing roller 15 in a printing position P6 opposed to a secondary transfer roller 16. That is, for example, this is elaectrostatically attracted by transfer voltage applied to the secondary transfer roller 16 to be transferred from the intermediate transfer belt 12 to the sheet 2. After the secondary transfer, the sheet 2 passes through the inside of a fixing unit 17 and is delivered to a discharge tray 19 by a discharge roller 18. When passing through the fixing unit 17, the toner image is fixed to the sheet 2 by heating and pressurization.

An upper-stage paper feed tray 25*a*, a middle-stage paper feed tray 25*b*, and a lower-stage paper feed tray 25*c* basically have similar configurations, and it is possible to set a large number of sheets 2 (2*a*, 2*b*, and 2*c*) in them, respectively. Setting is intended to mean putting so as to be stacked on the paper feed tray. In the paper feed trays 25*a* to 25*c*, sizes and types of the sheets 2*a* to 2*c* to be set are the same in some cases or the sizes or types are different in other cases.

Also, even if the sizes are the same, a direction (setting direction) with respect to a conveying direction M1 might be different. That is, the sheet 2 is a rectangle having a long side and a short side in general, and there is a case where this is set in a so-called "vertical manner" in which the long side is parallel to the conveying direction M1 and a case where this is set in a so-called "horizontal manner" in which the long side is orthogonal to the conveying direction M1.

The paper feed trays 25*a* to 25*c* are provided with size sensors 26*a*, 26*b*, and 26*c*, respectively, for detecting the sizes and directions of the set sheets 2*a* to 2*c*. These size sensors 26*a* to 26*c* may detect the size and direction at a timing before the sheets 2*a* to 2*c* are started to be conveyed.

Note that, the size sensors 26*a* to 26*c* may detect positions of movable matching members arranged so as to be in contact with edges of the sheets 2*a* to 2*c* in order to locate the sheets 2*a* to 2*c* as the sizes and directions of the sheets 2*a* to 2*c*.

A large number of sheets 2*d* may also be set so as to be stacked on the manual feed tray 25*d*. If the size is within an allowable range, the direction may be horizontal or vertical. The sheet 2*d* may be a long sheet that cannot be accommodated in the paper feed trays 25*a* to 25*c*. The manual feed tray 25*d* is provided with a manual feed size sensor 26*d* for detecting the size and direction of the set sheet 2*d*.

Note that, hereinafter, the paper feed trays 25*a* to 25*c* and the manual feed tray 25*d* are sometimes referred to as "trays 25" without distinction.

A conveyance path 30 through which the sheet 2 passes in the image forming device 1 includes paper feed paths 31, 32, 33, and 34 corresponding to the four trays 25, respectively, and a common path 35. The paper feed paths 31 to 34 are paths through which only the sheet 2 taken out from the corresponding tray 25 passes. On the other hand, the common path 35 is a path through which all of the sheets 2*a*, 2*b*, 2*c*, and 2*d* set in different trays 25 pass, that is, the path common to the four trays 25. In this embodiment, since the manual feed tray 25*d* is arranged above the upper-stage paper feed tray 25*a*, a path from a junction P4 being a terminal end of the paper feed path 34 to the discharge roller 18 is the common path 35.

The image forming device 1 is provided with a sheet attribute sensor 41 for detecting the type of the sheet 2 and sets an operating condition of printing depending on the type detected on the basis of an output of the sheet attribute sensor 41 such that an appropriate image may be obtained. The operating condition is a combination of a plurality of operating condition values such as a process speed, a transfer output, and a fixing temperature. The process speed is a condition which regulates a peripheral speed of the photoreceptor 4 and the conveying speed of the sheet 2, the transfer output is output voltage of a high-voltage power source which biases the secondary transfer roller 16 and the like, and the fixing temperature is a heating temperature in the fixing unit 17.

The sheet attribute sensor 41 is arranged in a position on an upstream side of the printing position P6 in the common path 35, in detail, between the timing roller 15 and the junction P4.

By arranging the same on the common path 35, it is possible to detect the type of the sheets 2*a*, 2*b*, 2*c*, and 2*d* by the single sheet attribute sensor 41 regardless of the number of the trays 25, and it is possible to reduce the size and cost by reducing the number of sensors.

In addition, by arranging the same on the upstream side of the timing roller 15, in a case of switching the conditions of the printing operation after detecting the type, it is possible to allow the sheet 2 to stand by in front of the printing position P6 as necessary to ensure switching time.

The sheet attribute sensor 41 obtains information used for discriminating the type from the sheet 2. For example, the sheet attribute sensor 41 being an optical sensor irradiates the sheet 2 which is moving toward the timing roller 15 with detection light, and obtains a received light amount of the detection light passing through the sheet 2 as information specifying a basis weight of the sheet 2. Then, a detection signal indicating the received light amount is transmitted to the control circuit 100. The control circuit 100 specifies the basis weight from the received light amount and detects the type of the sheet 2 with reference to information to be described later indicating correspondence between the basis weight and the type of sheet.

When starting executing the input print job, the image forming device 1 selects any one of the trays 25 according to specification by the job. For example, the tray 25 in which the sheet 2 corresponding to an output image size specified by the job is set is selected. Alternatively, when the tray 25 is specified by the job, the specified tray 25 is selected.

Then, in a case where the type of the sheet 2 previously detected is stored for the selected tray 25, the operating condition corresponding to the stored type is set, the sheet 2 is taken out from the selected tray 25, and the printing is performed under the set operating condition. In this case, detection of the type based on the output of the sheet attribute sensor 41 is not performed.

On the other hand, in a case where the type of the sheet 2 is not stored for the selected tray 25, the sheet 2 is taken out from the selected tray 25 and conveyed to the timing roller 15, and in the meantime, the type of the sheet 2 is detected on the basis of the output of the sheet attribute sensor 41. Then, the operating condition corresponding to the detected type is set and the printing is performed. Note that, in a continuous print job, the type is detected for the first sheet 2, and the type is not detected for the second and subsequent sheets 2.

In the image forming device 1, an "automatic mode" in which the type of the sheet 2 is automatically detected and the operating condition of the printing is set in this manner, and a "manual mode" in which the operating condition is set according to the type specified by a user performing a predetermined operation, that is, the manually input type are provided.

Then, a plurality of types (automatic types) included in an automatic type group automatically detected by the image forming device 1 and a plurality of types (manual types) included in a manual type group which may be specified by the user are different from each other at least partially. That is, division (classification) of the sheets 2 appropriate for the automatic mode and the manual mode is performed, so that the automatic type group and the manual type group are different from each other.

Hereinafter, the configuration and operation of the image forming device 1 are described focusing on a function of using the automatic type group and the manual type group differently.

Figure 2:
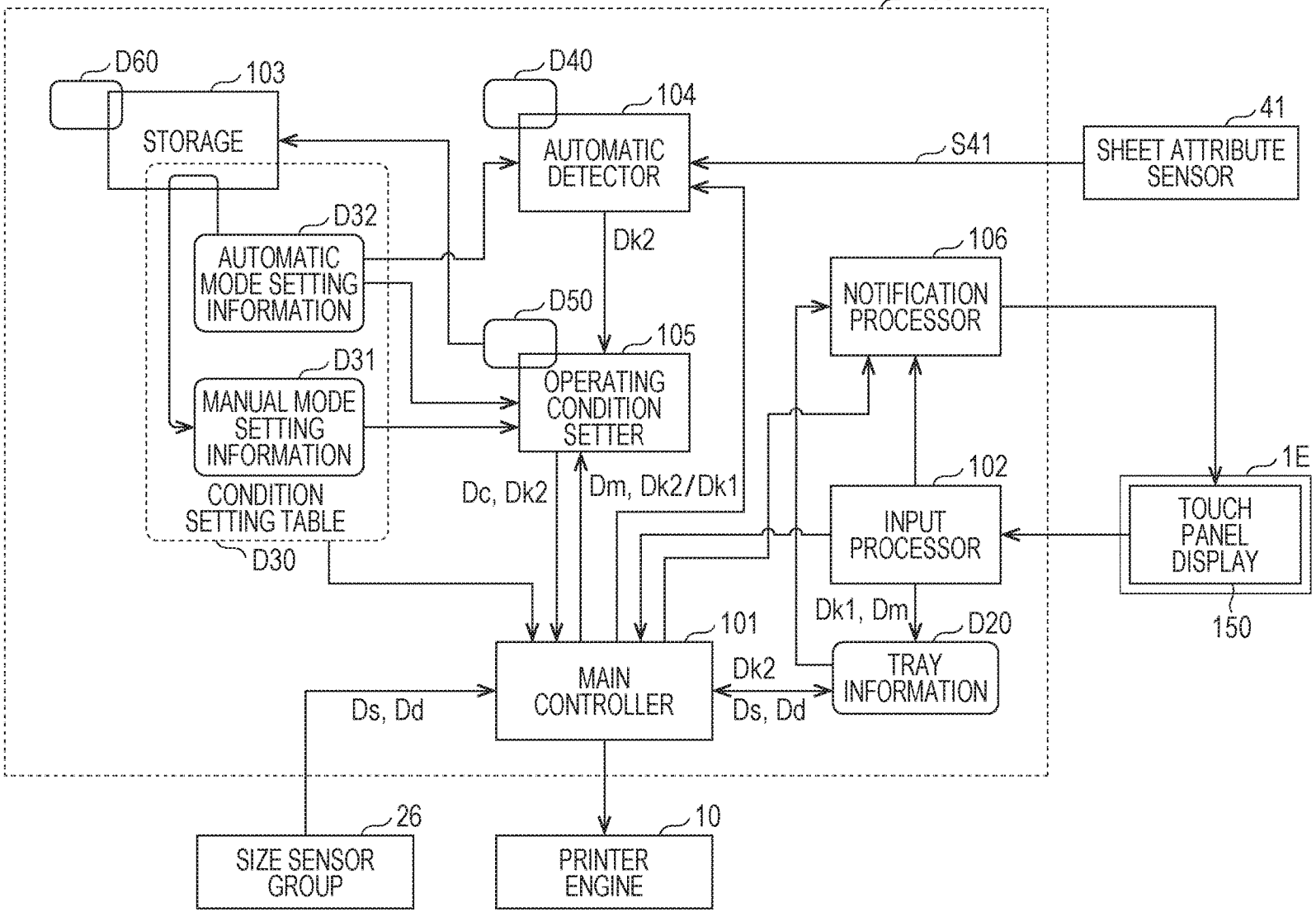
FIG. 2 is a view illustrating a functional configuration of a control circuit.
Figure 5A:
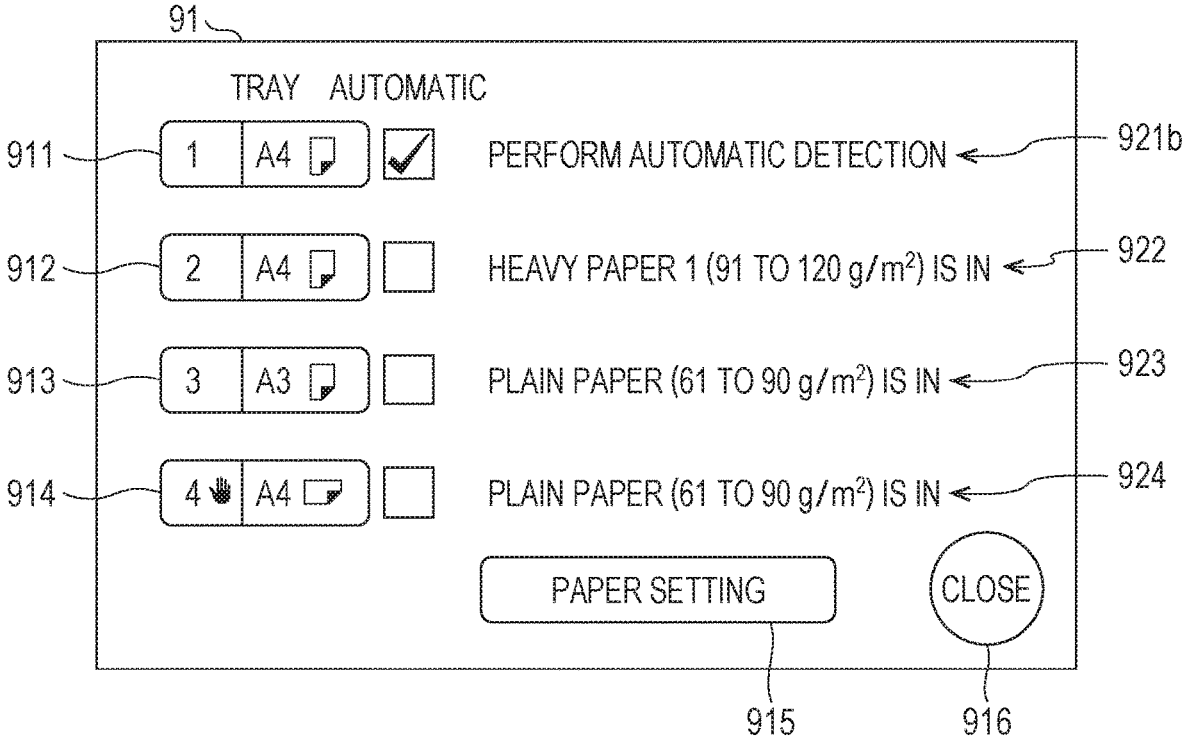
FIGS. 5A and 5B are views illustrating examples of a sheet information display screen.
Figure 5B:
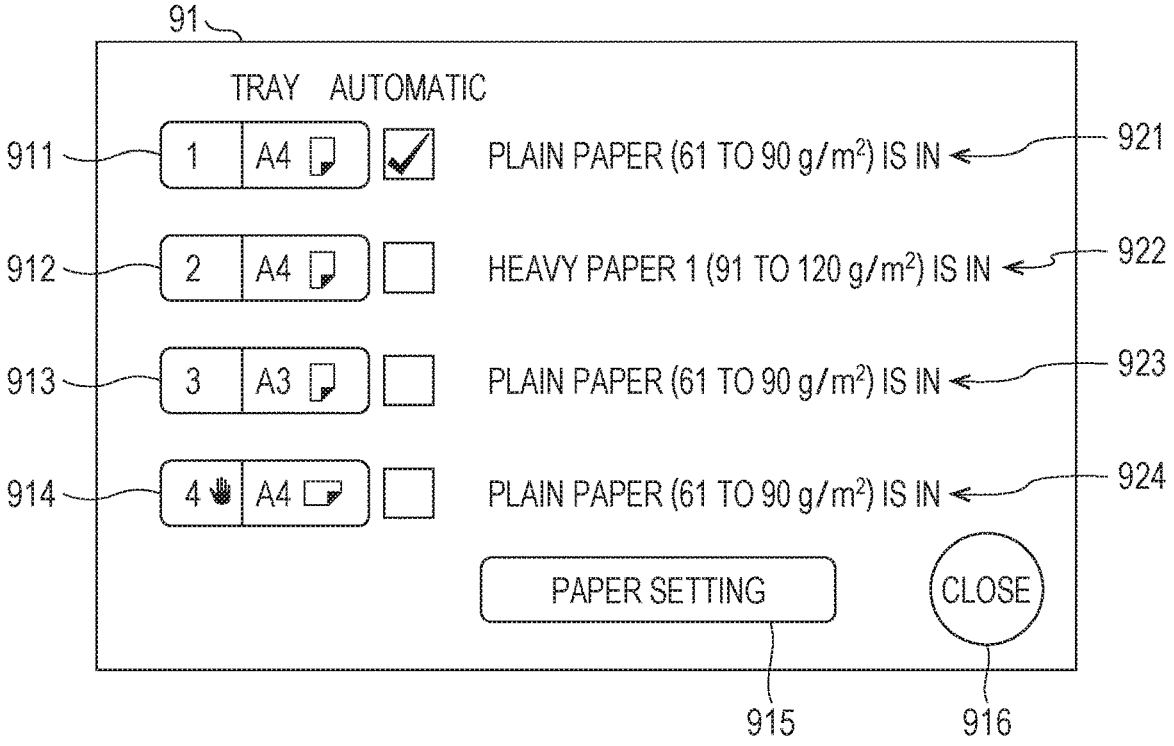
Figure 6:
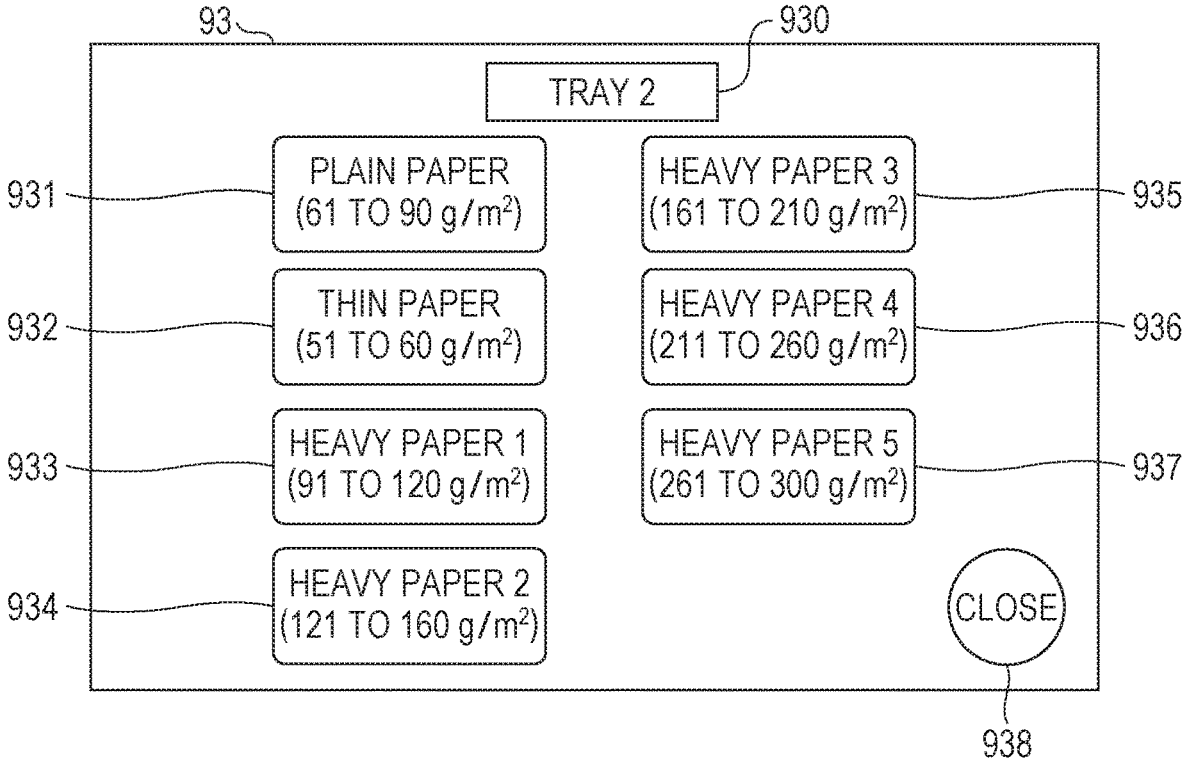
FIG. 6 is a view illustrating an example of a type setting screen.
Figure 7:
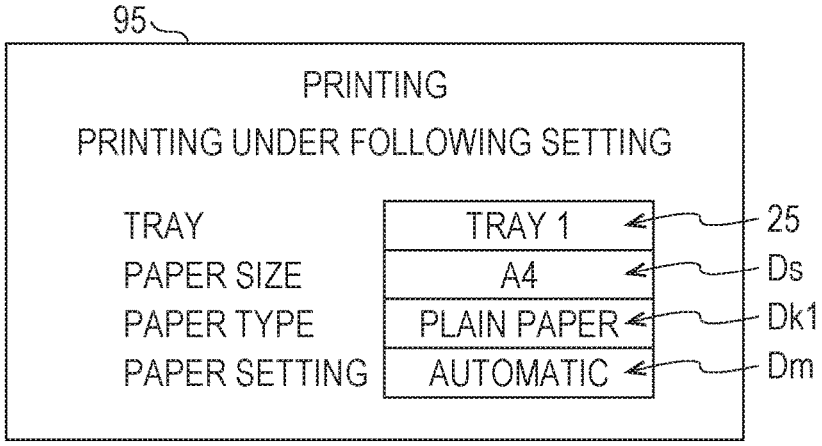
FIG. 7 is a view illustrating an example of an automatic detection notification screen.

FIG. 2 illustrates a functional configuration of the control circuit 100. Also, FIG. 3 illustrates an example of an operating condition setting table D30, FIGS. 4A and 4B illustrate a data configuration of tray information D20, FIGS. 5A and 5B illustrate examples of a sheet information display screen 91, FIG. 6 illustrates an example of a type setting screen 93, and FIG. 7 illustrates an example of an automatic detection notification screen 95.

In FIG. 2, the control circuit 100 includes a main controller 101, an input processor 102, a storage 103, an automatic detector 104, an operating condition setter 105, a notification processor 106 and the like. The functions are realized by a hardware configuration of the control circuit 100 including a central processing unit (CPU) and by a control program being executed by the CPU.

The main controller 101 is a controller that is responsible for overall control of the image forming device 1. When the print job is input by the operation using the operation panel 1E or communication with an external device, the main controller 101 controls the printer engine 10 or the like to perform printing of the number of sheets specified by the print job.

Also, the main controller 101 detects a size Ds and a direction Dd of the sheet 2 set in each tray 25 by a size sensor group 26, that is, the size sensors 26*a* to 26*c* and the manual feed size sensor 26*d*. Then, the detected size Ds and direction Dd are written in a predetermined memory as a part of the tray information D20.

The input processor 102 discriminates an instruction of the user based on the signal from the operation panel 1E and transmits the discriminated instruction to the main controller 101. Also, this requests the notification processor 106 to switch a screen to be displayed on a touch panel display 150 in response to the operation by the user.

In addition to these basic inputting processes, the input processor 102 accepts a manual input which is an operation of specifying any one of a plurality of types (manual types) included in the manual type group as the type of the sheet 2. This process includes a process of updating the tray information D20 so as to store the specified type.

The storage 103 stores the condition setting table D30 indicating manual mode setting information D31 and automatic mode setting information D32. The manual mode setting information D31 indicates operating condition values corresponding to a plurality of manual types included in the manual type group, respectively, and the automatic mode setting information D32 indicates operating condition values corresponding to a plurality of types (automatic types) included in the automatic type group, respectively.

In the example in FIG. 3, a manual type group MK indicated by the manual mode setting information D31 includes seven manual types Dk1 with type names of thin paper, plain paper, heavy paper 1, heavy paper 2, heavy paper 3, heavy paper 4, and heavy paper 5. These manual types Dk1 are types obtained by classifying the sheets 2 according to basis weight, and different basis weight ranges Dr1 correspond to them, respectively. The basis weight range Dr1 is a divided attribute value range obtained by dividing an assumed range (51 to 300 g/square meter) of the basis weight which is the attribute value of the sheet 2 into seven pieces.

Three operating condition values Dc of a process speed Dc1, a fixing temperature Dc2, and a transfer output Dc3 are associated with each of the seven manual types Dk1.

On the other hand, an automatic type group AK indicated by the automatic mode setting information D32 includes 14 automatic types Dk2 with type names of thin paper A, thin paper B, plain paper A, plain paper B, heavy paper 1A, heavy paper 1B, heavy paper 2A, heavy paper 2B, heavy paper 3A, heavy paper 3B, heavy paper 4A, heavy paper 4B, heavy paper 5A, and heavy paper 5B. As is the case with the manual types Dk1, the automatic types Dk2 are types classified according to basis weight, and different basis weight ranges Dr2 correspond to them, respectively.

As is the case with the basis weight range Dr1 corresponding to the manual type Dk1, the basis weight range Dr2 is a divided attribute value range obtained by dividing the assumed range of basis weight (51 to 300 g/square meter) into 14 pieces. However, the number of division is not seven but 14, twice the same.

In detail, the 14 basis weight ranges Dr2 are obtained by dividing the basis weight range Dr1 corresponding to each of the seven manual types Dk1 into two pieces. That is, the assumed range of the basis weight is divided so as to divide each of the thin paper, the plain paper, the heavy paper 1, the heavy paper 2, the heavy paper 3, the heavy paper 4, and the heavy paper 5 which are the manual types Dk1 into two automatic types Dk2.

Accordingly, an entire range of the 14 basis weight ranges Dr2 is equal to the entire range of the seven basis weight ranges Dr1, but each of the basis weight ranges Dr2 is different from any of the seven basis weight ranges Dr1.

The three operating condition values Dc of the process speed Dc1, the fixing temperature Dc2, and the transfer output Dc3 are associated with each of 14 automatic types Dk2 also in the automatic mode setting information D32.

With reference to FIG. 2 again, the automatic detector 104 detects the automatic type Dk2 of the sheet 2 taken out from the tray 25 and conveyed to the common path 35 based on a detection signal S41 output from the sheet attribute sensor 41. In detail, when this receives a detection instruction from the main controller 101, this takes in the detection signal S41 and discriminates the basis weight of the sheet 2 with reference to discrimination information D40 indicating a relationship between a value of the detection signal S41 and the basis weight. Subsequently, with reference to the automatic mode setting information D32, the automatic type Dk2 corresponding to the discriminated basis weight is obtained as a detection result. Then, the operating condition setter 105 is notified of the automatic type Dk2 detected in this manner.

When receiving the setting request from the main controller 101, the operating condition setter 105 sets the operating condition of the printing. The setting request includes a mode Dm which is data indicating which of the above-described automatic mode and manual mode is specified by the user. In addition, in a case where the automatic mode is specified, the previously detected automatic type Dk2 or a notification of newly detecting the automatic type Dk2 is included, and in a case where the manual mode is specified, the manual type Dk1 of the sheet 2 specified for the selected tray 25 is included.

In a case where the automatic mode is specified and the setting request includes the notification of detecting the automatic type Dk2, the operating condition setter 105 waits for the notification of the automatic type Dk2 from the automatic detector 104 and performs the setting process. When the automatic mode is specified and the setting request includes the already detected automatic type Dk2, this immediately performs the setting process without waiting for the notification from the automatic detector 104.

As the setting process, when the automatic mode is specified, the operating condition setter 105 sets the operating condition value Dc corresponding to the detected automatic type Dk2 among the operating condition values Dc indicated by the automatic mode setting information D32 as the operating condition. When the manual mode is specified, the operating condition value Dc corresponding to the manual type Dk1 specified by the manual input among the operating condition values Dc indicated by the manual mode setting information D31 is set as the operating condition.

Then, the operating condition setter 105 notifies the main controller 101 of the set operating condition value Dc. The main controller 101 controls the printer engine 10, a driving source of sheet conveyance and the like by using the notified operating condition value Dc as a control target value.

As illustrated in FIGS. 4A and 4B, the tray information D20 indicates the size Ds and direction Dd of the set sheet 2, the mode (automatic or manual) Dm specified by the user, the manual type Dk1 specified by the user, and the detected automatic type Dk2 for each tray 25.

In the tray information D20 in FIG. 4A, the mode Dm specified for the paper feed tray 25*a* (tray 1 in the drawing) is the automatic mode. Therefore, the manual type Dk1 related to the manual mode is not illustrated. Also, in the state in FIG. 4A, the automatic type Dk2 related to the automatic mode is unknown. This means that the automatic type Dk2 is not detected after the sheet 2 is set in the paper feed tray 25*a* or that it is determined that there is possibility that the sheet 2 is replaced because an operation of drawing the paper feed tray 25*a* is performed after it is detected, so that the previous detection result is invalidated.

Note that, regarding the paper feed trays 25*b* and 26*b* and the manual feed tray 25*d* (tray 2, tray 3, and tray 4 in the drawing), the manual mode is specified, and the manual type Dk1 specified by the user is indicated for each of them.

In the state in FIG. 4A, for example, when the print job to select the paper feed tray 25*a* is input, the main controller 101 controls to take out the sheet 2 from the paper feed tray 25*a*, and also instructs the automatic detector 104 to detect the automatic type Dk2. When the automatic type Dk2 is detected and the operating condition value Dc corresponding to the result is set by the operating condition setter 105, the main controller 101 controls the printing operation as described above and updates the tray information D20 so as to store the detected automatic type Dk2. Upon this updating, the manual type Dk1 corresponding to the detected automatic type Dk2 is extracted from the condition setting table D30 and added to the tray information D20.

FIG. 4B illustrates an example of a state updated from the state in FIG. 4A in this manner. In the example in FIG. 4B, the automatic type Dk2 of the tray 1 is the plain paper A, and the plain paper is indicated as the manual type Dk1 corresponding to the automatic type Dk2.

The sheet information display screen 91 illustrated in FIGS. 5A and 5B includes tray selecting buttons 911, 912, 913, and 914 corresponding to the four trays 25, respectively. Each of the tray selecting buttons 911 to 914 is an icon indicating the size of the sheet 2 set in the corresponding tray 25 with a letter and the direction thereof with a figure.

In addition, check buttons for the user to specify the automatic mode or the manual mode are arranged in association with the tray selecting buttons 911 to 914, respectively. Each time the user touches the check button, the automatic mode and the manual mode are alternately switched. In a state in which the automatic mode is specified, a check mark is on the check button, and in a state in which the manual mode is specified, the check mark is not thereon.

In the examples in FIGS. 5A and 5B, the automatic mode is specified for the paper feed tray 25*a* (tray 1), and the manual mode is specified for the other paper feed trays 25*b* and 26*b* and the manual feed tray 25*d* (trays 2 to 4).

Furthermore, in the sheet information display screen 91, the manual types Dk1 corresponding to the sheets 2 and messages 921, 922, 923, and 924 indicating the basis weight ranges Dr1 thereof are displayed for the respective trays 25 regardless of whether they are in the automatic mode or the manual mode. That is, even in the automatic mode, not the detected automatic type Dk2 itself but the manual type Dk1 corresponding to the detected automatic type Dk2 is displayed as the type of the sheet 2.

The manual type Dk1 is displayed even in the automatic mode in this manner because the automatic type Dk2 is not an option specified by the user, so that the user might be confused when the automatic type Dk2 is displayed.

Also, when the automatic type Dk2 is unknown as described above for the tray 25 in which the automatic mode is specified, as illustrated in FIG. 5A, a message 921*b* indicating that the type of the sheet 2 is automatically detected is displayed in place of the message 921.

The user may confirm the size Ds, the direction Dd, and the type (manual type Dk1) of the sheet 2 set in each tray 25 and specify the automatic mode or the manual by the sheet information display screen 91. When the user touches a close button 916, the display of the sheet information display screen 91 is finished.

Alternatively, when specifying or changing the type of the sheet 2 for the tray 25 for which the manual mode is specified, the user may touch a sheet setting button 915 in a state in which the tray 25 to be specified or changed is selected by the tray selecting buttons 911 to 914.

When the user touches the sheet setting button 915, the type setting screen 93 illustrated in FIG. 6 is displayed. The type setting screen 93 includes an icon 930 indicating a target tray, selecting buttons 931 to 937 corresponding to options of the manual type Dk1 and a close button 938.

The user specifies the manual type Dk1 for the target tray by touching any one of the selecting buttons 931 to 937. When the close button 938 is touched, the displayed screen returns to the sheet information display screen 91.

With reference to FIG. 2 again, the notification processor 106 notifies of the manual type Dk1 corresponding to the detected automatic type Dk2 as a process of notifying the user of the detection result of the automatic type Dk2. The manual type Dk1 corresponding to the automatic type Dk2 is the manual type Dk1 corresponding to the basis weight range Dr1 including the basis weight range Dr2 of the automatic type Dk2 and is indicated by the tray information D20.

When the display of the sheet information display screen 91 is requested by the input processor 102, the notification processor 106 reads the manual type Dk1 corresponding to the automatic type Dk2 from the tray information D20. Then, as in the message 921 in FIG. 5B, the manual type Dk1 is displayed on the touch panel display 150 in place of the automatic type Dk2. Note that, the content to be notified regarding the type may include the manual type Dk1, and a message indicating both the manual type Dk1 and the automatic type Dk2 may also be displayed.

In addition, when the automatic type Dk2 is detected in the print job, the notification processor 106 pop-up displays the automatic detection notification screen 95 illustrated in FIG. 7 on the touch panel display 150 in accordance with an instruction from the main controller 101. When the job being executed is input from a host device, this is displayed on a display of the host device. The automatic detection notification screen 95 illustrates the selected tray 25, the size Ds of the sheet 2, the manual type Dk1, and the mode Dm.

Figure 8:
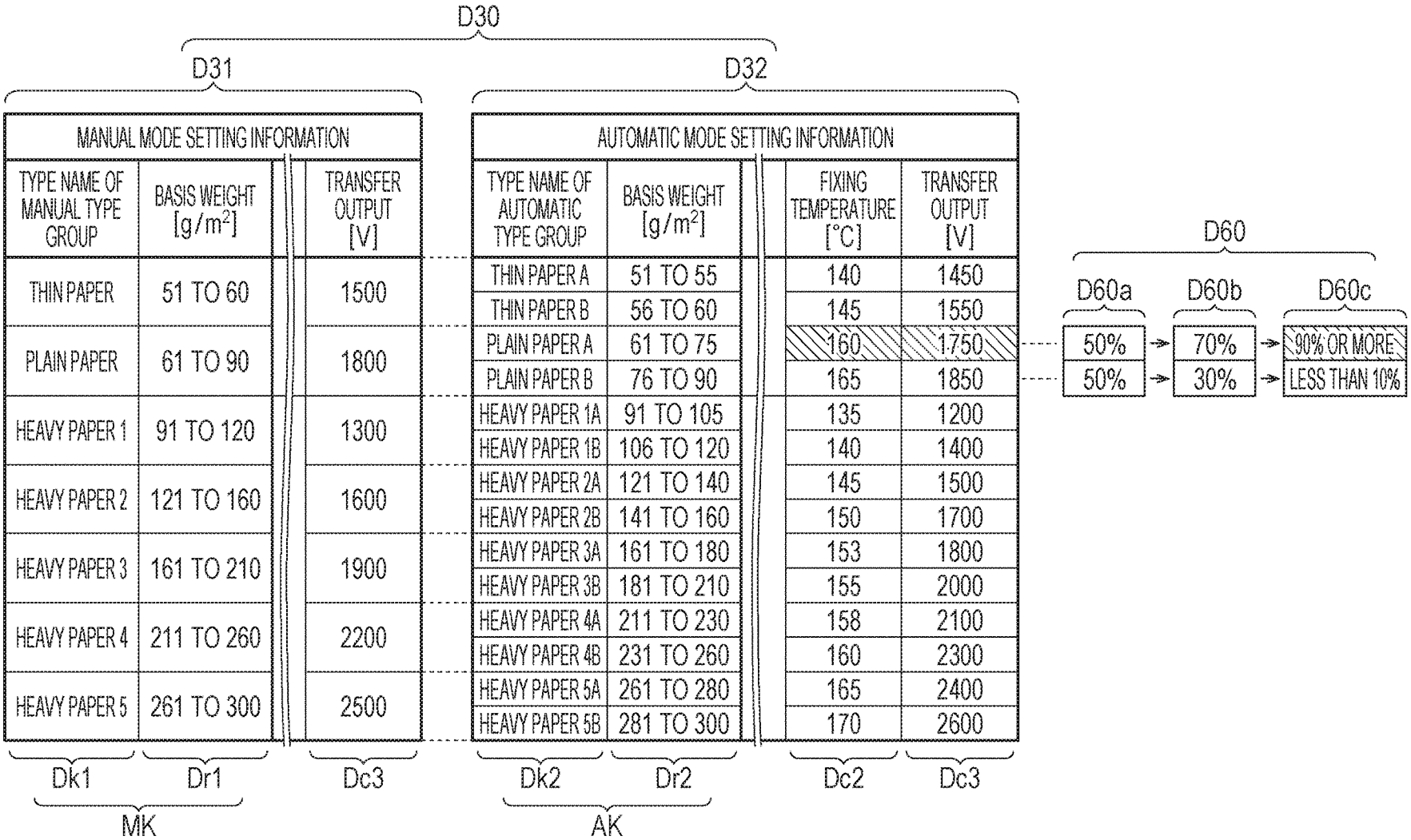
FIG. 8 is a view illustrating an example of setting frequency information accompanying automatic mode setting information.

FIG. 8 illustrates an example of setting frequency information D60 accompanying the automatic mode setting information D32, and FIG. 9 illustrates an example of changing the manual mode setting information D31 based on the setting frequency information D60.

With reference also to FIG. 2, the operating condition setter 105 updates setting history information D50 each time the operating condition value Dc is set in the automatic mode. The setting history information D50 is data indicating the automatic type Dk2 corresponding to the set operating condition value Dc.

Each time the setting history information D50 is updated, the storage 103 updates the setting frequency information D60 as illustrated in FIG. 8. The setting frequency information D60 is data indicating occurrence frequency for each automatic type Dk2 of the automatic mode setting information D32 in the setting history information D50. In detail, this is a ratio of the numbers of times of occurrence of two automatic types Dk2 corresponding to the same manual type Dk1 in the setting history information D50. In further detail, this is the ratio of the numbers of times of occurrence after the sum of the cumulative numbers of times of occurrence of the two automatic types Dk2 exceeds a set value (for example, 1000).

The storage 103 calculates such ratio and stores the same as the setting frequency information D60. FIG. 8 illustrates transition of the setting frequency information D60 for the plain paper A and plain paper B which are the automatic types Dk2 corresponding to the plain paper of the manual type Dk1.

In setting frequency information D60*a* at a first time point, the ratio of the plain paper A is 50% and the ratio of the plain paper B is also 50%. In setting frequency information D60*b* at a second time point after the first time point, the ratio of the plain paper A increases to 70%, and the ratio of the plain paper B decreases to 30%. Furthermore, in setting frequency information D60*c* at a third time point after the second time point, the ratio of the plain paper A increases to 90%, and the ratio of the plain paper B decreases to 10%. That is, in the example in FIG. 8, cases where the user uses the plain paper A is much more than cases where the plain paper B is used.

When the ratio of any automatic type Dk2 exceeds a threshold (for example, 90%) in the setting frequency information D60, the storage 103 detects the automatic type Dk2 as a high-frequency type. In the example in FIG. 8, the high-frequency type is the plain paper A. Then, as illustrated in FIG. 9, the operating condition value Dc of the manual mode setting information D is changed. That is, the operating condition value Dc of the manual type Dk1 corresponding to the basis weight range Dr1 including the basis weight range Dr2 corresponding to the high-frequency type is replaced with the operating condition value Dc of the high-frequency type.

In FIG. 9, the manual mode setting information D31 before change and manual mode setting information D31*a* after the change are illustrated. In the example in FIG. 9, the fixing temperature Dc2 corresponding to the plain paper of the manual type Dk1 is changed from 165° C. to 160° C., and the transfer output Dc3 is changed from 1800 V to 1750 V. The fixing temperature Dc2 (160° C.) and the transfer output Dc3 (1750 V) after the change are the fixing temperature Dc2 and the transfer output Dc3 of the plain paper A in the automatic mode setting information D32 (refer to FIG. 8).

Note that, since the process speed Dc1 of the plain paper A in the automatic mode setting information D32 is equal to the process speed Dc1 of the plain paper in the manual mode setting information D31, it is not necessary to change the manual mode setting information D31 for the process speed Dc1.

Also, when the frequency of the high-frequency type becomes lower than the threshold, the storage 103 may perform a process of returning the operating condition value Dc of the corresponding manual type Dk1 to a default value.

Figure 11:
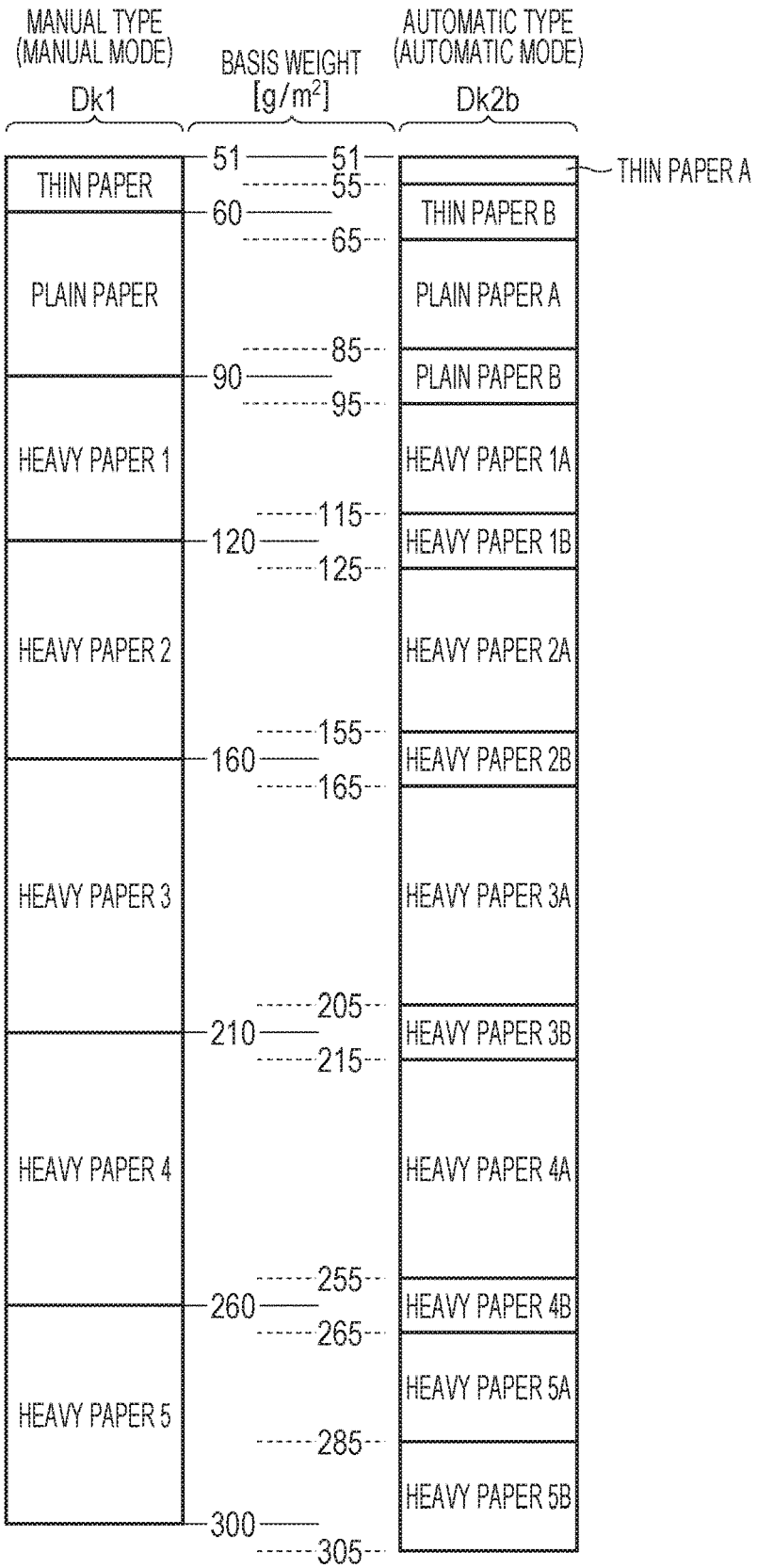
FIG. 11 is a view illustrating a relationship between attribute values of types included in a manual type group and attribute values of types included in an automatic type group in the variation in FIG. 10.

FIG. 10 illustrates a variation of the operating condition setting table D30, and FIG. 11 illustrates a relationship between an attribute value of the manual type Dk1 and an attribute value of the automatic type Dk2 in the variation in FIG. 10.

An operating condition setting table D30*b* illustrated in FIG. 10 includes the manual mode setting information D31 and automatic mode setting information D32*b*. The manual mode setting information D31 is similar to that in FIG. 3.

As in the example in FIG. 3, the automatic type Dk2 included in an automatic type group AKb indicated by the automatic mode setting information D32*b* includes 14 types of thin paper A, thin paper B, plain paper A, plain paper B, heavy paper 1A, heavy paper 1B, heavy paper 2A, heavy paper 2B, heavy paper 3A, heavy paper 3B, heavy paper 4A, heavy paper 4B, heavy paper 5A, and heavy paper 5B. Different basis weight ranges Dr2*b* correspond to the automatic types Dk2, respectively.

As illustrated well in FIG. 11, the automatic types Dk2 in the automatic mode setting information D32*b* are determined such that a boundary between the basis weight ranges Dr2*b* corresponding to them is shifted from a boundary between the basis weight ranges Dr1 corresponding to a plurality of manual types Dk1. Details are as follows.

Basically, as in the example in FIG. 3, 14 basis weight ranges Dr2*b* are obtained by dividing the basis weight range Dr1 corresponding to each of the seven manual types Dk1 into two. That is, the assumed range of the basis weight is divided such that two automatic types Dk2 correspond to each of the thin paper, the plain paper, the heavy paper 1, the heavy paper 2, the heavy paper 3, the heavy paper 4, and the heavy paper 5 which are the manual types Dk1.

However, an upper limit value of the basis weight range Dr2*b* of the thin paper B having the larger basis weight among the thin paper A and the thin paper B corresponding to the thin paper of the manual type Dk1 is selected to be a slightly larger value (65) than an upper limit value (60) of the basis weight range Dr1 of the thin paper. An upper limit value of the basis weight range Dr2*b* of the thin paper A on a side of the smaller basis weight is selected to be a value (55) between a lower limit value (51) and the upper limit value (60) of the basis weight range Dr1 of the thin paper.

Similarly, as for the plain paper A and plain paper B, the heavy paper 1A and heavy paper 1B, the heavy paper 2A and heavy paper 2B, the heavy paper 3A and heavy paper 3B, the heavy paper 4A and heavy paper 4B, and the heavy paper 5A and heavy paper 5B, the upper limit value of the basis weight range Dr2*b* corresponding to them is selected.

That is, the upper limit values of the basis weight ranges Dr2*b* corresponding to the plain paper B, the heavy paper 1B, the heavy paper 2B, the heavy paper 3B, the heavy paper 4B, and the heavy paper 5B are slightly larger than the upper limit values of the basis weight ranges Dr1 corresponding to the plain paper, the heavy paper 1, the heavy paper 2, the heavy paper 3, the heavy paper 4, and the heavy paper 5, respectively, of the manual types Dk1. The upper limit values of the basis weight ranges Dr1 corresponding to the plain paper A, the heavy paper 1A, the heavy paper 2A, the heavy paper 3A, the heavy paper 4A, and the heavy paper 5A are values between the lower limit value and the upper limit value of the basis weight ranges Dr1 corresponding to the plain paper, the heavy paper 1, the heavy paper 2, the heavy paper 3, the heavy paper 4, and the heavy paper 5, respectively, of the manual types Dk1.

Therefore, an entire range of the 14 basis weight ranges Dr2*b* is slightly wider than the entire range of the seven basis weight ranges Dr1, and each of the basis weight ranges Dr2*b* is different from any of the seven basis weight ranges Dr1.

In this manner, by shifting the boundary between the basis weight ranges Dr2*b* with respect to the boundary between the basis weight ranges Dr1, unevenness in image quality between printed matters may be reduced. For example, a case in which an average basis weight of the plain paper frequently used by the user is close to the upper limit value (90) of the basis weight range Dr1 of the plain paper of the manual type Dk1, and an actual basis weight exceeds or not the upper limit value due to lot variation or change in humidity is assumed. In this case, if the upper limit value of the basis weight range Dr2*b* of the plain paper B is equal to the upper limit value of the basis weight range Dr1 as in the example in FIG. 3, it is possible that the printing is performed under the operating condition of the plain paper B in some cases and the printing is performed under the operating condition of the heavy paper 1 in other cases. That is, disadvantage might occur that even though the user sets the sheets 2 of the same item number, the printing is performed under different operating conditions depending on the sheets 2, which may cause slight difference in image quality. By dividing the basis weight range Dr2*b* as in the example in FIG. 10, occurrence of such disadvantage may be reduced.

FIG. 12 illustrates another variation of the operating condition setting table D30.

An operating condition setting table D30*c* illustrated in FIG. 12 includes the manual mode setting information D31 and automatic mode setting information D32*c*. The manual mode setting information D31 is similar to that in FIGS. 3 and 10.

An automatic type group AKc indicated by the automatic mode setting information D32*c* includes 10 automatic types Dk2*c* which are thin paper A, thin paper B, plain paper A, plain paper B, heavy paper 1A, heavy paper 1B, heavy paper 2, heavy paper 3, heavy paper 4, and heavy paper 5. As is the case with the manual types Dk1, the automatic types Dk2*c* are the types classified according to basis weight, and different basis weight ranges Dr2*c* correspond to them, respectively. The three operating condition values Dc of the process speed Dc1, the fixing temperature Dc2, and the transfer output Dc3 are associated with each of the 10 manual types Dk2*c*.

Out of the 10 automatic types Dk2*c*, the automatic types Dk2*c* corresponding to the thin paper A and the thin paper B are obtained by dividing the basis weight range Dr1 corresponding to the thin paper which is the manual type Dk1 having the small basis weight among the seven manual types Dk1 into two. The reason for this is as follows.

In the thin sheet 2, difference in basis weight significantly affects a transfer quality and occurrence of curl (bending) at the time of fixing as compared to the sheet 2 relatively thicker such as the plain paper. That is, it is necessary to strictly set the operating conditions of transfer and fixing. Therefore, the basis weight range Dr1 corresponding to the thin paper of the manual type Dk1 is divided.

Four out of the 10 automatic types Dk2*c* which are plain paper A, plain paper B, heavy paper 1A, and heavy paper 1B correspond to two of the seven manual types Dk1 which are plain paper and heavy paper 1. The plain paper and the heavy paper 1 are two adjacent to each other in arrangement in order of size of basis weight with which different values of the process speed Dc1 are associated in the manual mode setting information D31. The basis weight range Dr2*c* corresponding to each of the four automatic types Dk2*c* is obtained by dividing the basis weight range Dr1 corresponding to each of the plain paper and the heavy paper 1 of the manual types Dk1 into two for the following reasons.

The process speed Dc1 is different between the plain paper and the heavy paper 1 of the manual types Dk1. In order to prevent difference in image quality between the plain paper and the heavy paper 1, it is preferable to finely set the fixing temperature Dc2 and the transfer output Dc3 which are other operating condition values Dc.

The remaining four of the automatic types Dk2*c* correspond to the heavy paper 2, the heavy paper 3, the heavy paper 4, and the heavy paper 5 of the manual types Dk1, respectively. That is, the basis weight ranges Dr2*c* corresponding to the four automatic types Dk2*c* are equal to the basis weight ranges Dr1 corresponding to the heavy paper 2, the heavy paper 3, the heavy paper 4, and the heavy paper 5 of the manual types Dk1.

Note that, among the automatic types Dk2*c*, the basis weight ranges Dr2*c* corresponding to six which are thin paper A, thin paper B, plain paper A, plain paper B, heavy paper 1A, and heavy paper 1B are different from any of the basis weight ranges Dr1 corresponds to seven manual types Dk1.

Figure 13:
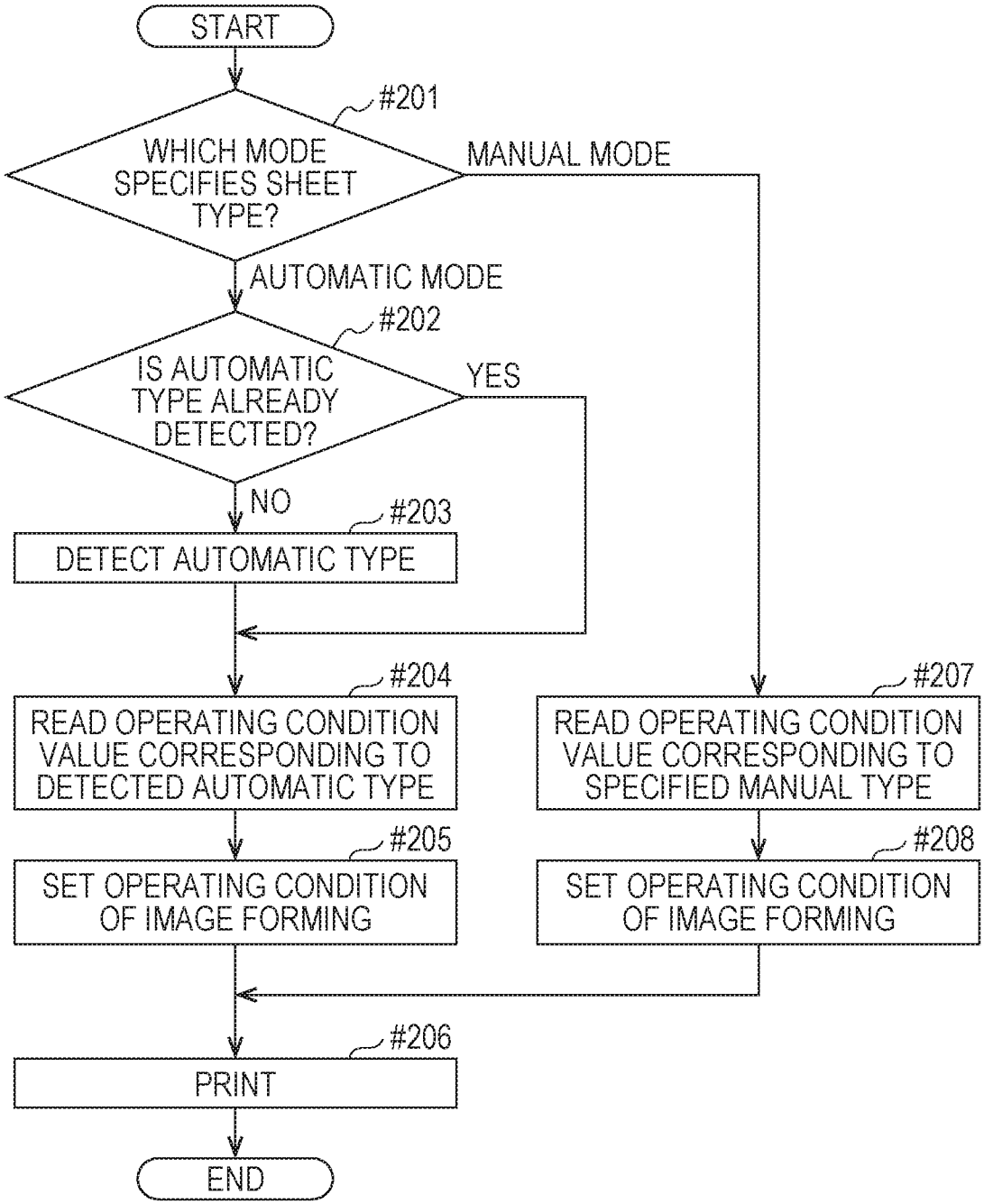
FIG. 13 is a view illustrating a process flow at the start of a print job in the image forming device.

FIG. 13 illustrates a process flow when the print job is started in the image forming device 1.

The mode Dm specified for the tray 25 selected according to the print job is confirmed with reference to the tray information D20 (#201).

When this is the automatic mode, it is checked whether the already detected automatic type Dk2 is stored as the tray information D20 (#202). When the automatic type Dk2 is not stored (NO at #202), the sheet 2 is conveyed from the selected tray 25 and the automatic type Dk2 thereof is detected (#203), and thereafter the procedure shifts to step #204. When the automatic type Dk2 is stored (YES at #202), step #203 is skipped and the procedure shifts to step #204.

At step #204, the operating condition value Dc associated with the newly or previously detected automatic type Dk2 is read from the automatic mode setting information D32. Then, the printing is performed by setting the read operating condition value Dc as the operating condition (#205 and #206).

On the other hand, when the mode Dm specified by the user is the manual mode (#201), the manual type Dk1 specified by the user is read out from the manual mode setting information D31 to be set as the operating condition, and the printing is performed (#207, #208, and #206).

According to the above-described embodiment, since there are the manual mode setting information D31 and the automatic mode setting information D32 with different divisions of the basis weight as the classifying attribute value of the sheet 2, it is possible to set the operating condition of printing by using them differently. That is, when setting the operating conditions of printing according to the type of the sheet 2, it is possible to satisfy advantages of both the automatic detection and manual input of the type.

According to the above-described embodiment, in the automatic mode, since the operating condition is set according to the automatic types Dk2 obtained by subdividing a plurality of manual types Dk1 related to the manual mode, it is possible to finely set the operating condition without increasing burden on the user.

According to the above-described embodiment, since the operating condition value Dc in the manual mode setting information D32 is changed by detecting the high-frequency type, when the user frequently uses the sheet 2 of the same manual type Dk1, it is possible to reflect a result of the automatic detection of the automatic type Dk2 in the printing in the manual mode. Also when using the automatic mode setting information D32*b* and D32*c*, as in the case of using the automatic mode setting information D32, the setting frequency information D60 is provided to detect the high-frequency type, and the operating condition value Dc in the manual mode setting information D32 may be changed as necessary.

In the above-described embodiment, the division and the number of the manual types Dk1 and the automatic types Dk2, Dk2*b*, and Dk2*c* are not limited to those illustrated and may be arbitrarily selected. The attribute value may be other than the basis weight, for example, thickness, smoothness, reflectance, color and the like, or a combination of the basis weight and other attribute values. A displacement sensor for detecting the thickness of the sheet 2, a capacitance sensor for detecting the water content, a camera for imaging the surface of the sheet 2, an ultrasonic sensor for detecting overlap, joint, step or the like, or other sensors may be appropriately combined to form the sheet attribute sensor 41.

In the above-described embodiment, the condition setting tables D30, D30*b*, and D30*c* in which the number of automatic types Dk2, Dk2*b*, and Dk2*c* is larger than the number of manual types Dk1 is illustrated, but the present invention is not limited to this. The number of the manual types Dk1 may be made larger than the number of the automatic types Dk2, Dk2*b*, and Dk2*c*. For example, the automatic types Dk2 may be limited to those classified by one or two attribute values in consideration of the cost of the sheet attribute sensor 41, and the manual type Dk1 may be determined to include a special sheet 2 (envelope, multiple leaf slips and the like) classified by the combination of three or more attribute values.

The sheet attribute sensor 41 may be arranged on each of a plurality of trays 25. In this case, like the size Ds, it is possible to detect the automatic type Dk2 at any time without conveying the sheet 2.

In addition, the configuration of the entire or each part of the image forming device 1, the contents, order, or timing of the processes, the data configuration of the tray information D20, the items and the number of the operating conditions, the specific value of the operating condition value Dc, the threshold of the frequency regarding the detection of the high-frequency type, the configuration of the screen for manually inputting the manual type Dk1 and the mode Dm and the like may be appropriately changed in accordance with the gist of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming device that forms an image on a sheet under an operating condition set according to a type of the sheet, the image forming device comprising a hardware processor that:

accepts a manual input specifying any one of a plurality of types included in a manual type group as the type of the sheet;

stores manual mode setting information indicating an operating condition value corresponding to each of the plurality of types included in the manual type group, and automatic mode setting information indicating an operating condition value corresponding to each of a plurality of types included in an automatic type group;

detects which of the plurality of types included in the automatic type group the type of the sheet is based on an output of a sensor that detects the type of the sheet; and sets an operating condition value corresponding to a type detected by the automatic detector out of the operating condition values indicated by the automatic mode setting information as the operating condition in an automatic mode, and sets an operating condition value corresponding to the type specified by the manual input out of the operating condition values indicated by the manual mode setting information as the operating condition in a manual mode, wherein at least two types included in the automatic type group are different from any of the types included in the manual type group.

2. The image forming device according to claim 1, wherein the number of types included in the automatic type group is larger than the number of types included in the manual type group.

3. The image forming device according to claim 2, wherein at least two types included in the automatic type group are obtained by dividing one type included in the manual type group.

4. The image forming device according to claim 3, wherein an image forming speed is determined as the operating condition value, and at least four types included in the automatic type group correspond to two types adjacent to each other in arrangement in order of size of attribute values that determine types of the sheet with which different values of the image forming speed are associated in the manual setting information in the manual type group, and ranges of the attribute values corresponding to the four types are obtained by dividing ranges of the attribute values corresponding to the two types.

5. The image forming device according to claim 3, wherein an attribute value that determines the type of the sheet is a basis weight, and as for one type having a small basis weight included in the manual type group, at least two types including a range of the basis weight obtained by further dividing the basis weight are included in the automatic type group.

6. The image forming device according to claim 1, wherein a range of an attribute value that determines the type of the sheet in the types included in the automatic type group is determined so as to be shifted from a range of the attribute value corresponding to the type included in the manual type group.

7. The image forming device according to claim 1, wherein a transfer output in an electrophotographic process is determined as the operating condition value.

8. The image forming device according to claim 1, wherein a fixing temperature in an electrophotographic process is determined as the operating condition value.

9. The image forming device according to claim 1, wherein the hardware processor detects a type in which frequency set as the operating condition is not smaller than a threshold out of the types included in the automatic type group as a high-frequency type based on a history of setting, and replaces the operating condition value of the type detected as the high-frequency type with the operating condition value of the type in the manual mode setting information corresponding to the value.

10. The image forming device according to claim 1, wherein, as a process of notifying a user of a type detected, the hardware processor notifies of also a type of the manual type group corresponding to the type of the detected automatic type group.

* * * * *